United States Patent [19]

Hamilton

[11] 4,333,617

[45] Jun. 8, 1982

[54] PIN-TURNING ARTICLES AND METHODS, FOR HANDLING LOAD OBJECTS

[76] Inventor: Martin B. Hamilton, Box 97, Wesley, Iowa 50483

[21] Appl. No.: 245,083

[22] Filed: Mar. 18, 1981

[51] Int. Cl.[3] ..... B65H 75/40

[52] U.S. Cl. ..... 242/86.52; 254/8 R; 254/131; 280/46; 280/47.24

[58] Field of Search ..... 242/86.52, 86.5 R, 79, 242/58.6, 86.2, 54 R, 55; 254/8 R, 131; 280/46, 47.17–47.26; 414/911, 910, 24.6, 444, 457, 490

[56] References Cited

U.S. PATENT DOCUMENTS

| | | | |
|---|---|---|---|
| 1,081,093 | 12/1913 | Chapman et al. | 254/8 R |
| 1,103,429 | 7/1914 | Pitkin | 280/47.26 X |
| 1,192,981 | 8/1916 | Boehck | 254/8 R |
| 1,242,111 | 10/1917 | Hopkins . | |
| 1,254,778 | 1/1918 | Comfort | 280/47.24 X |
| 1,307,600 | 6/1919 | Rose et al. . | |
| 1,333,645 | 3/1920 | Walker . | |
| 1,740,404 | 12/1929 | Kalberer | 280/46 |
| 1,854,156 | 4/1932 | Germond, Jr. | 280/46 |
| 2,271,624 | 2/1942 | Cochran . | |
| 2,418,522 | 4/1947 | Needham | 242/86.2 X |
| 2,601,960 | 7/1952 | Hick | 242/139 |
| 2,636,623 | 4/1953 | Corley . | |
| 2,652,207 | 9/1953 | Goedken | 242/58.6 |
| 2,677,476 | 5/1954 | Bebinger | 242/79 X |
| 3,050,273 | 8/1962 | Saunders | 242/86.52 |
| 3,534,880 | 10/1970 | Washburn, Jr. et al. . | |
| 3,638,815 | 2/1972 | Fincher . | |
| 3,667,728 | 6/1972 | Garelick | 254/8 R |
| 3,702,139 | 11/1972 | Chaffin . | |
| 3,916,801 | 11/1975 | Henderson | 105/486 |
| 3,944,094 | 3/1976 | Compton . | |
| 4,169,581 | 10/1979 | Thurmond, Jr. | 254/45 |
| 4,188,164 | 2/1980 | Hansen | 414/447 |

OTHER PUBLICATIONS

"Trailer Stabilizing Jacks", 1980 Thomas Register Catalog File at p. 2256.

"abc Trailer Dollys", undated catalog illustration.

*Primary Examiner*—John M. Jillions

*Attorney, Agent, or Firm*—James F. Hollander

[57] ABSTRACT

A load is lifted and moved by a pin-turning transporter-and-lift-member combination. The transporter has a body, and wheels for permitting the body to move along a surface. The transporter body includes a lifting pin and a weight supporting plate fixed relative to the lifting pin, together with an assembly for turning the lifting pin around an axis parallel to the surface and perpendicular to the pin so that the pin and the pin-turning axis lie in a common geometric plane for substantial mechanical advantage. The lift member has an elongated section for slidable attachment to the load and further has a receptacle portion for pivotably and slidably receiving the lifting pin perpendicular to the elongated section. The receptacle also includes a second weight supporting plate to carry the load pivotably on the weight supporting plate of the transporter body.

In a method of use, (A) the lifting member is slidably attached to the load, as by insertion into or onto the load, (B) the transporter is oriented so that the pin-turning axis is parallel to the elongated section of the lift member, (C) the transporter is used to insert the pin into the lift member receptacle, (D) turn the pin to lift the load clear of the surface, and (E) transport the load over the surface.

A variety of selectable-height receptacles, motorized and manual transporter arrangements and other variations and applications are described.

18 Claims, 27 Drawing Figures

FIG.2
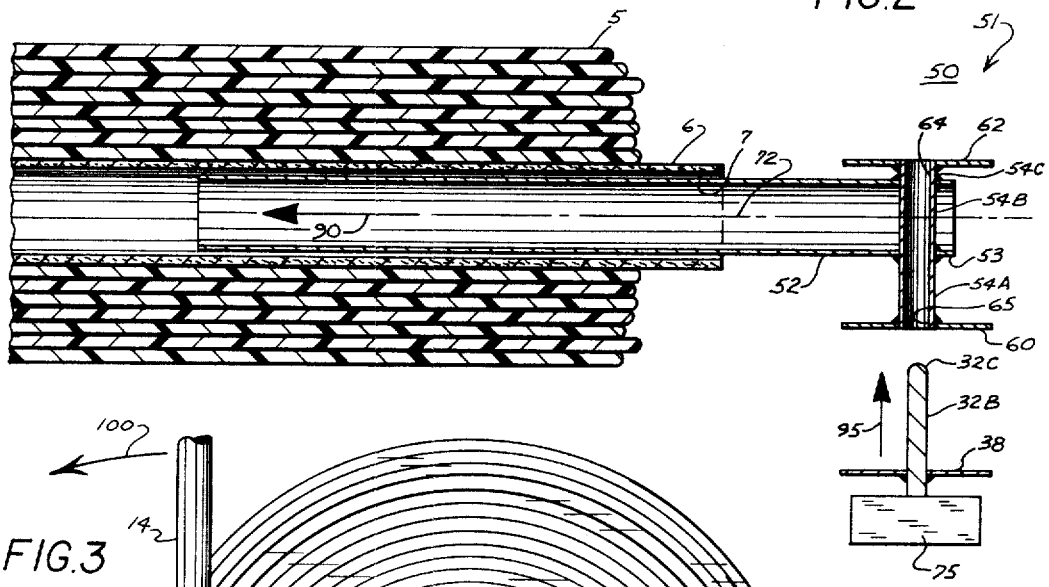
FIG.3
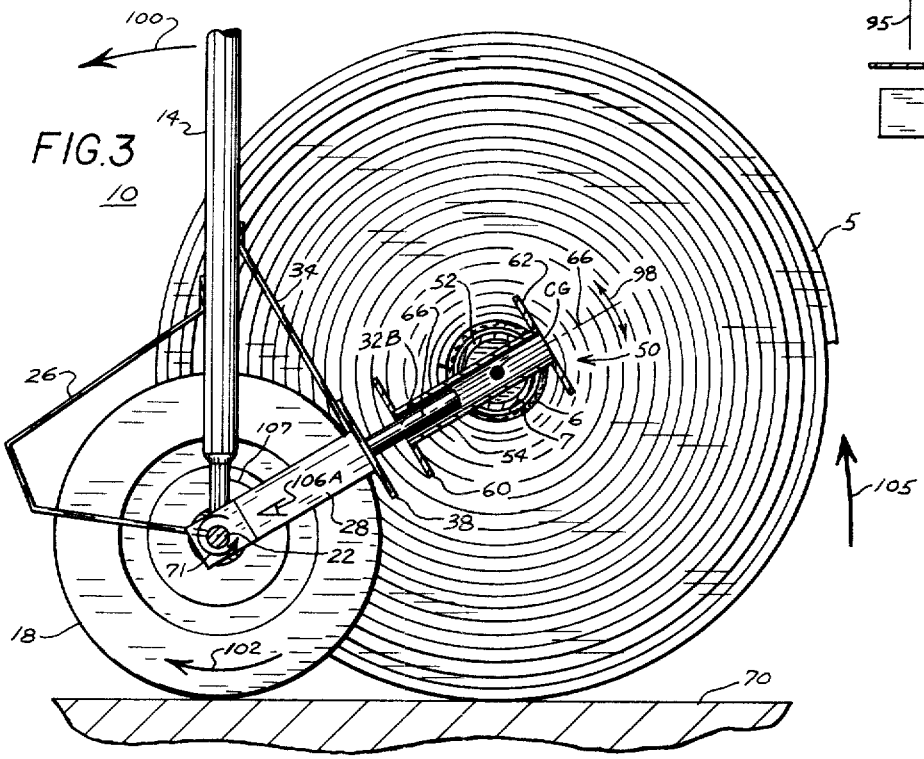
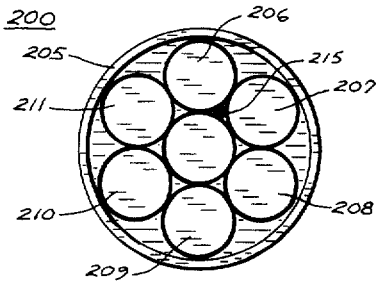
FIG.9
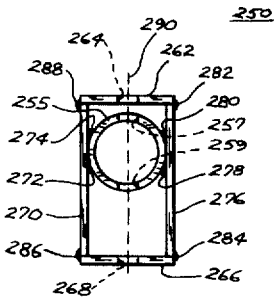
FIG.10

FIG.5
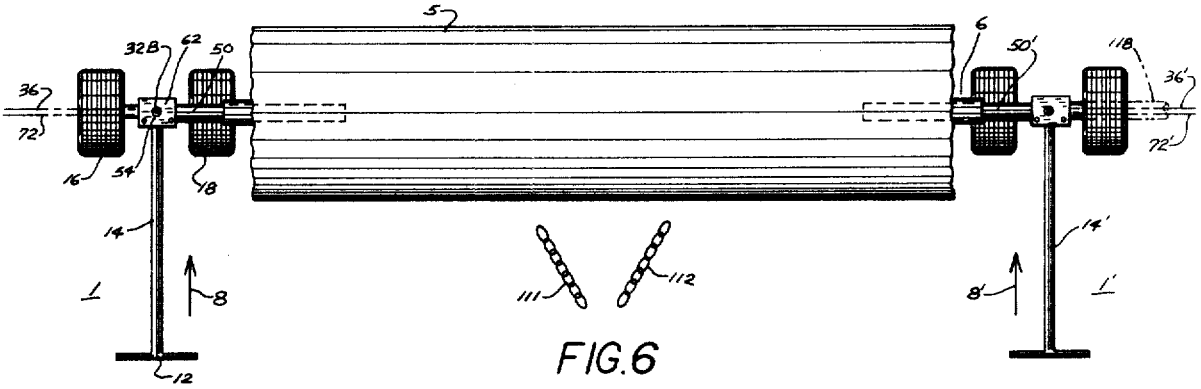
FIG.6
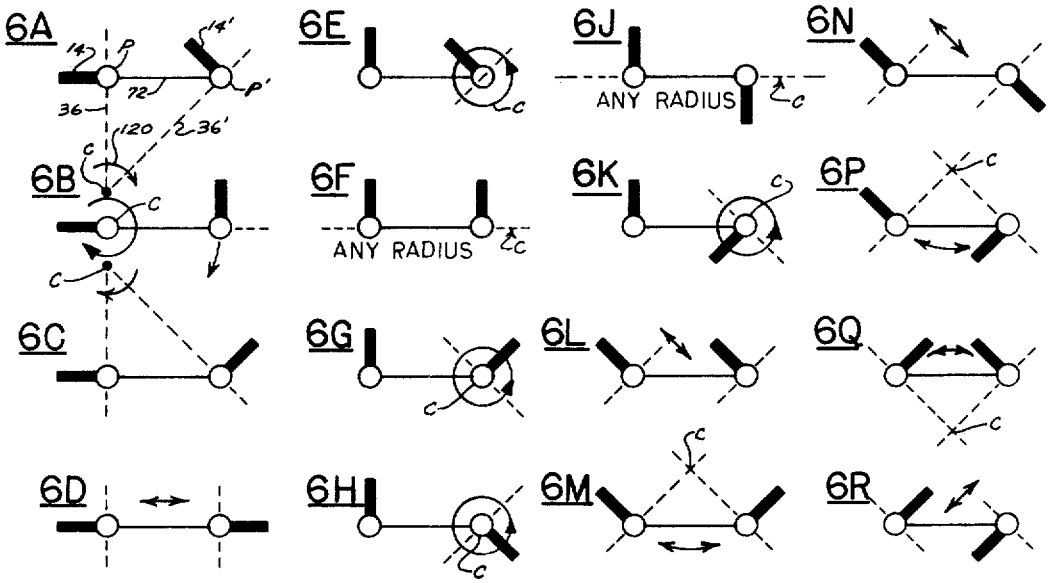
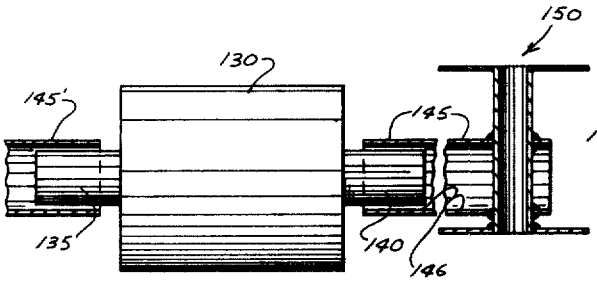
FIG.7
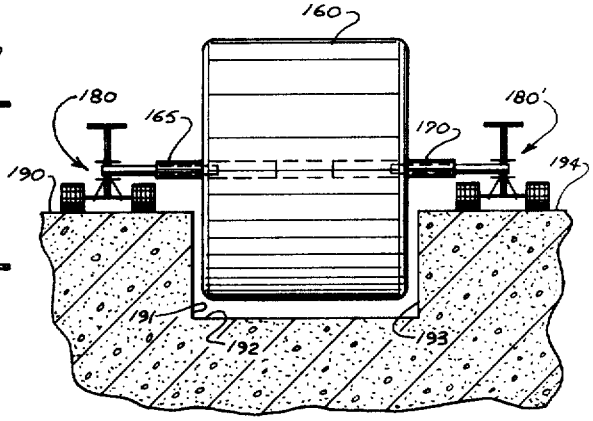
FIG.8

PIN-TURNING ARTICLES AND METHODS, FOR HANDLING LOAD OBJECTS

BACKGROUND OF THE INVENTION

The present invention relates to the field of materials handling, which involves methods and articles of manufacture for lifting, moving and otherwise handling load objects. More specifically, the present invention relates to lifting, moving and otherwise handling load objects by methods and articles of manufacture involving the use of pivot pins and other elongated members.

Cochran U.S. Pat. No. 2,271,624 suggests a type of tier-lift truck provided with a forwardly-projecting articulated bar for engaging the hollow of a bulk load and elevating same. In the manual materials-handling field, dollies having a dolly body for placing the heavy article and rolling on wheels are well known. However, where the size of the article is too unwieldy or its material is too fragile to withstand substantial handling, such dollies cannot be used at all or their size, numbers, and expense become unmanageable.

An important goal in the materials handling equipment field is profitability, which is suitably defined as the ratio of the annual profits of a business allocable to the use of the equipment to the cost of the equipment. The cost of the equipment at least includes the sum of the annual depreciation on the purchase price, plus fuel and maintenance costs, plus labor costs of using the equipment, plus allocable costs of accidents during use. Annual depreciation plus maintenance can be reduced by finding a more inexpensive design with a higher load-carrying figure of merit in a simple structure with as few moving parts as possible to do the same job. (Load-carrying figure of merit is definable as the maximum load weight capacity of the unit divided by the weight of the unit itself.) Labor costs can be reduced by finding a design which provides substantial mechanical advantage in the lifting process, high load-carrying figure of merit, reduces the number of laborers required to do a job, and reduces the time required to do the job. Costs of accidents during use can be reduced by finding a design which reduces or eliminates dangerous occupational situations and body strains which contribute significantly to the frequency, severity, and cost of accidents.

Without limiting the generality of application of the invention to be disclosed, the background of the invention is further described in the context of one specific field of application, the handling of membrane roofing rolls on the flat roofs of buildings. Such roofing membrane rolls are provided wound on hollow rigid tubes having tube ends projecting from the roll. Heretofore, the application of such rolls to roof structures has been a labor-intensive project, involving six to ten laborers lifting and positioning such rolls weighing, for instance 700 and 1400 and even 2400 pounds (more than a metric ton). The roofing membrane is a relatively soft material that can be gashed and abraded when roughly handled. Frequently, building roofs include tight spaces between constraining sidewall dimensions that complicate and slow down the roll-handling process. The roof structure of the building upon which the membrane is to be laid is frequently of limited strength, so that mechanical handling equipment cannot be very heavy if it is to be used at all; otherwise the roof structure will be punctured and significant accident damage and financial exposure will result. Time-consuming procedures of semipermanent attachment and detachment of handling equipment must be avoided and tedious positioning steps minimized. Different sizes of rolls must be movable with the same equipment.

SUMMARY OF THE INVENTION

In the present invention, the load body is lifted and moved by a pin-turning transporter and lift member combination article of manufacture. The transporter has a body and means, such as wheels or tracks, for permitting its movement along a surface. The body includes a lifting pin and a weight supporting means, together with an assembly for turning the lifting pin around an axis parallel to the surface and perpendicular to the pin so that the pin and the pin-turning axis lie in a common geometric plane for substantial mechanical advantage. The lift member has an elongated section for slidable attachment to the load body and further has a receptacle assembly for pivotably and slidably receiving the lifting pin substantially perpendicular to the elongated section. The receptacle assembly also includes second weight supporting means to carry the load pivotably on the weight supporting means of the transporter body.

In one of the methods of use, the lifting member is slidably attached or juxtaposed to the load body, the transporter is oriented so that the pin-turning axis is parallel to the elongated section of the lift member, and the transporter is used to insert the pin into the receptacle assembly and to turn the pin to lift the load clear of the surface and then transport the load over the surface. The method or methods of the invention are repeated with one or more additional units of the inventive article combination to lift and move an opposite end of a load body and additional lifting projections, lift holes or hollows in the load body.

In an interesting feature of some of the embodiments, the construction of the receptacle assembly of the lift member is so arranged so that a plurality of lifting height selections is available to the user, for example, by provision of lift plates as the second weight supporting means at unequal distances from but parallel to the direction of elongation of the lift member elongated section. Mere turning adjustment around the direction of elongation of the lift member relative to the load body prior to the pin insertion suffices to bring the selected lift plate and hence lifting-height selection into availability to the pin-turning transporter.

The invention permits embodiments of small size and simplicity of structure which exhibit remarkably large load-carrying figures of merit in addition to substantial mechanical advantage through the pin-turning feature. Accordingly, the invention permits the handling of the same loads with lower-cost equipment of the invention and with fewer workers more swiftly, reducing labor costs as well. In addition, it appears that the invention extends the state of the art also in the area of handling enormous load bodies not heretofore practicably or economically movable.

In the specific example of handling roofing membrane rolls, the invention is readily embodied by combining a lift member with a simple pin-carrying dolly having a long handle stem which turns the pin around the axis of the dolly wheels themselves. The lift member is a cylindrical tube which is holdably insertable into the roofing roll tube and which is provided with a receptacle assembly carrying high-lift and low-lift plates.

Notwithstanding the heavy roofing roll loads to be handled, only two laborers operating two units of the invention at each end of the roofing roll tube suffice to swiftly lift and rollably maneuver the heavy roll even through tight spaces to locations wherever selected on the roof and lay it down again. Slidable attachment of the lift member in the roll speeds the process of getting control of the load and then inserting the dolly pin into the receptacle of the lift member, in the first instance, and then later lowering the roll, removing the pin, and merely sliding out the lift member later. Strenuous upward lifting motion of heavy rolls by human laborers is obviated because the handle stem is pulled down to lift the roll up. The pin in cooperation with the receptacle provides excellent front-to-back and side-to-side stability for the lifted load. As soon as the roofing roll has been lifted, it is rapidly maneuvered in the moving process due to the pivotable, swivellable pin-and-receptacle arrangement, by guiding the handle stems of each dolly from side to side as required. The light but remarkably strong combination of dolly and lift member adds insignificant weight to roofs of limited structural strength. The relatively fragile roofing membrane is not damaged by the lifting and moving operation. Different sizes of rolls are movable with the same simple, light units because of the selectable lift plate feature.

BRIEF DESCRIPTION OF THE DRAWING

FIG. 2 is a partially cross-sectional, partially block diagrammatic, portrayal of insertion of the lift member and subsequent insertion of the pivot pin into the receptacle of the lift member, in initial steps of a preferred embodiment of the inventive method of using the article of manufacture of FIG. 1.

FIG. 3 is a partially cross-sectional, partially profile view of the embodiment of FIG. 1 during a levering step in the inventive method.

FIG. 5 is a plan view of the use of two of the embodiments of FIG. 1 for moving a roll of product by the inventive method.

FIGS. 6A–6R are a collection of 16 greatly simplified plan views of the use of two of the embodiments as in FIG. 5 swivellably for executing various moving maneuvers of the load to be moved.

FIG. 7 is a simplified front view in partial cross-section showing an additional approach for slidably attaching and holdably juxtaposing a load body by means of lift members in the practice of the invention.

FIG. 8 is a simplified front view in partial cross-section showing the use of two embodiments similar to FIG. 5 moving a large load body on a surface having shoulders.

FIG. 9 is a simplified end view of a bundle of load bodies suggesting the insertion of a lift member of an inventive article according to an inventive method.

FIG. 10 is an end view of an alternative receptacle assembly for a lift member in the combination article of the invention.

DETAILED DESCRIPTION OF THE DRAWING

Figure 1:
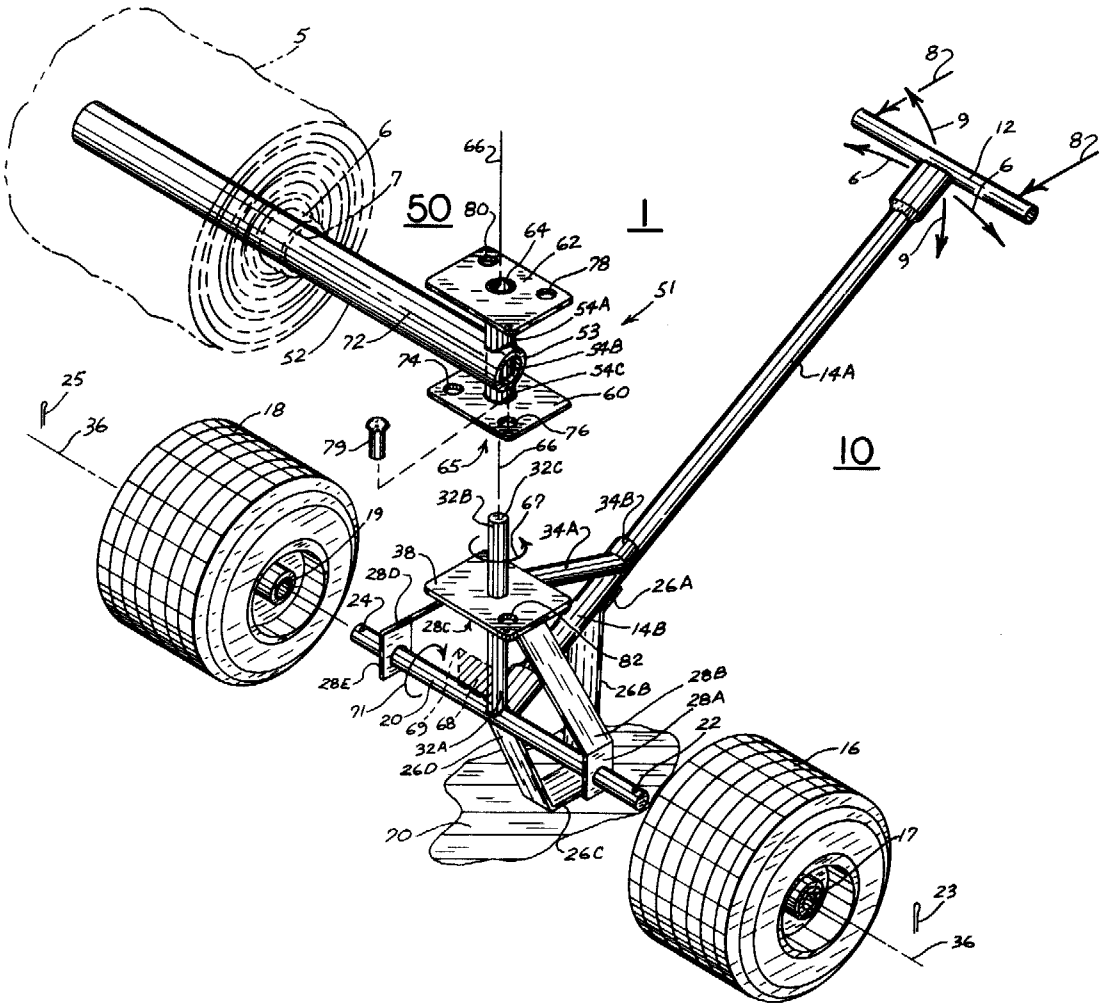
FIG. 1 is an exploded perspective view of the preferred embodiment lifting a roll of product.

In FIG. 1 materials handling apparatus 1 is a combination of lifting dolly 10 and lift member 50. Materials handling apparatus 1 effectively lifts and moves load body 5, which is a roll of product wound on hollow product tube 6.

Lift member 50 includes receptacle assembly 51 and cylindrical insert tube 52. Insert tube 52 has central axis 72 and end 53 through which tubular lift stem, or engagement tube, 54 is transversely affixed by being provided perpendicular to central axis 72. Lift stem, or engagement tube, 54 has a section 54B held in the interior of tube 52, and has sections 54A and 54C extending unequal distances from central axis 72 and from the exterior of insert tube 52. High-lift plate 62 and low-lift plate 60 are apertured at holes 64 and 65 and affixed around each end of sections 54A and 54C of tubular lift stem 54, in the manner of flanges for the lift stem 54. High-lift plate 62 and low-lift plate 60 are transverse to the lift stem 54 and parallel to central axis 72. Plates 60 and 62 with lift stem 54 form the receptacle assembly 51.

Lifting dolly 10 includes fixed axle 20 upon which tires 16 and 18 respectively are rotatably mounted by means of bearings 17 and 19 and held in place by cotter pins 23 and 25 provided through axle holes 22 and 24. A frame 28 of approximately U-shape is weldably affixed on axle 20 at each end 28A and 28E of the frame. Pivot pin 32 is affixed perpendicular to the approximate center of axle 20 and is further weldably affixed intermediately along its pin length to the approximate center 28C of the frame. Pivot pin 32 extends away from frame 28 as section 32B and terminates at pin end 32C. Fulcrum plate, or weight supporting plate, 38 is a flange-like part affixed to pivot pin section 32B and to the center 28C of frame 28 so that plate 38 is transverse to pivot pin 32. Frame sections 28B and 28D provide triangular rigidity and strength to the axle 20 and pin 32 as well as further supporting fulcrum plate 38.

Figure 4:
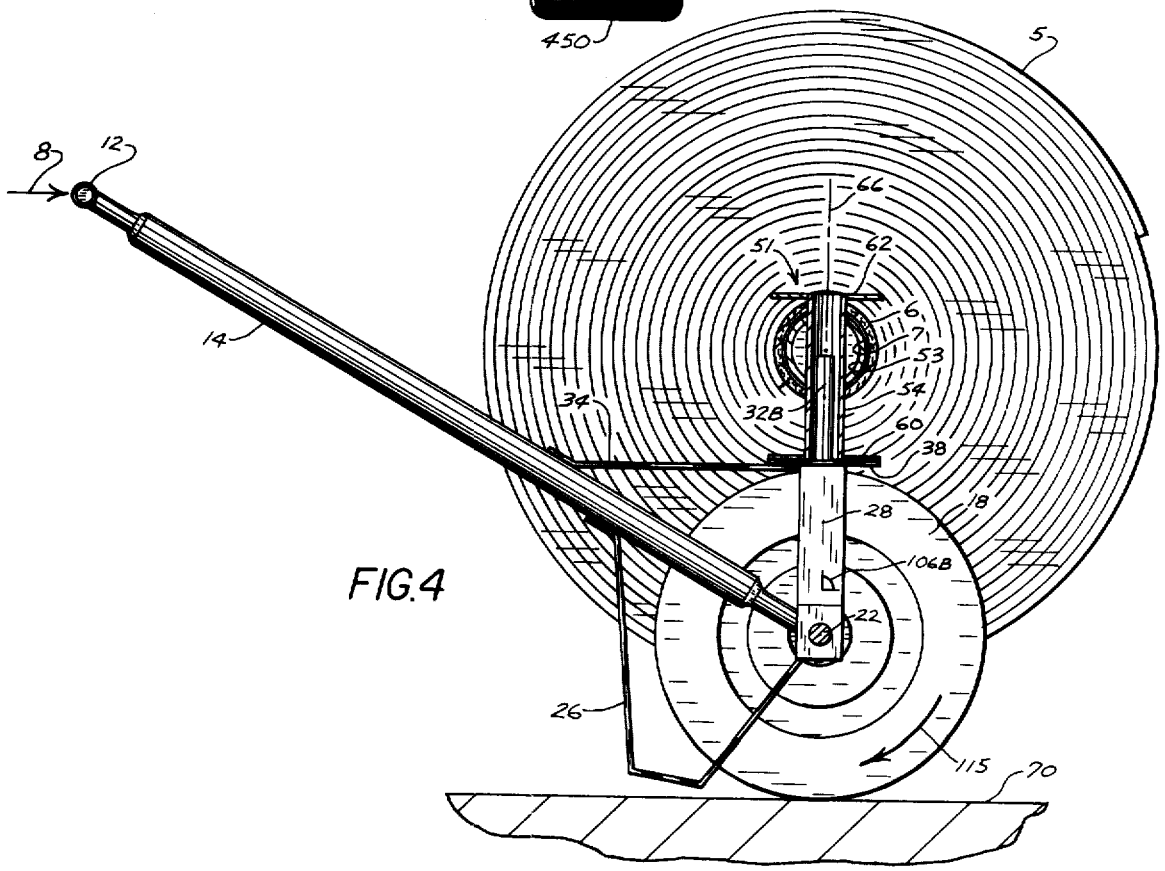
FIG. 4 is a partially cross-sectional, partially profile view of the embodiment of FIG. 1 as the levering step is completed and as the step of rollable transportation of the lifted product roll in the inventive method is begun.

Handle stem 14 is weldably affixed to the approximate center of axle 20 and hand grip 12 is provided distally from axle 20 on handle stem 14. Frame brace 34 is affixed at a forward end to the approximate center 28C of frame 28 and is affixed at the other end at section 34B to handle stem 14 so that the handle stem 14 is divided into distal section 14A and dolly section 14B and so that the handle stem 14 extends at an acute angle relative to a geometric plane 68 defined by pivot pin 32 and axle 20. (Distal section 14A is suitably detachable for compact storage.) A skid plate 26, which is an approximately J-shaped strap affixed at end 26A to handle stem 14 and at the other end 26D to the approximate center of axle 20, has support section 26B and base section 26C. The apparatus 1 is so constructed that it can rest in equilibrium on ground surface 70 on tires 16 and 18 and on skid plate 26 in three-point support. When the apparatus 1 is in the rest position, the pivot pin 32 is approximately vertical and suitably tilted slightly from vertical in the handle stem 14 direction, as shown in FIGS. 1 and 4.

Pivot pin 32 is insertable into tubular lift stem 54 so that pin end 32C and section 32B are protectively surrounded in lift stem 54, and so that either high-lift plate 62 or low-lift plate 60 support the weight of lift member 50 and load 5,6 on the weight supporting dolly fulcrum plate 38.

From a structural strength point of view the dolly 10 is advantageously triangularly braced in three dimensions by frame 28 in plane 68 and by the combination of frame brace 34A, handle section 14B and skid plate 26. Likewise handle stem 14 is strengthened by frame brace 34 and skid plate 26.

An embodiment of the inventive method of using the materials handling apparatus 1 is illustrated by comparing FIGS. 2,3,4, and 5 with FIG. 1. Referring now to FIG. 2, insert tube 52 of lift member 50 is inserted partway into the inside 7 of projecting product roll tube 6 in direction 90. Tube 52 is inserted far enough to obtain good lifting control on the load 5,6 by the slidably attachable and detachable cylindrical shape of tube 52. The inside diameter of tube 6 somewhat exceeds the diameter of insert tube 52, leaving some clearance for turning of the receptacle 51 assembly 54,60,62 of lift member 50.

Next, a transporter 75 (such as dolly 10 of FIG. 1) carrying a pin section 32B and weight support fulcrum plate 38 is brought near receptacle 51. The transporter or mechanism thereon is caused to move so that pin end 32C enters lift stem, or engaging tube, section 54A at entrance 65 until the pin section 32B has moved in direction 95 to the extent that good lifting control on the lift stem 54 and thereby the insert tube 52 has been secured. When a dolly 10 is used as in FIG. 3, the insertion of the pin section 32B into the lift stem 54 is readily accomplished by raising handle stem 14 to an approximately vertical position, which forms an acute angle 107 with pin 32, and then moving dolly 10 forward so that wheel 18 moves forwardly with rotation 102 along ground 70. The pin section 32B is readily prepared for insertion by manually guiding dolly 10 with foot force on axle 20 or hand guidance on skid plate 26 and frame brace 34 (which double as rudder handles).

In FIGS. 1 and 2 prior to insertion of the pin 32B, the lift member 50 rests both slidably to longitudinal motion in direction 90 and slidably to turning motion 98 around insert tube axis 72. Consequently, the lift stem 54 is readily slid longitudinally and turned clockwise or counterclockwise from the point of view of FIG. 3 so as to be ready for the insertion of pin 32B. In this way awkward sidewise dolly wheel movements are obviated. The pin end 32C in response to motion of dolly 10 can itself be used to catch entrance 65 and turn lift stem 54 with motion 98 so that pin section 32B can enter, since there is no heavy loading on the apparatus 1 at that time.

In a next step of the inventive method dolly 10 and lifting member 50 are levered by pulling back and downwardly in the direction 100 on the dolly 10, executing a turning 71 around axis 36, and lifting load 5,6 in the direction 105 approximately normal to the ground surface 70.

In FIGS. 1 and 3 the dolly 10 is oriented so that the wheel axis and the pin-turning axis (which interestingly coincide as axis 36 of FIG. 1 in this embodiment) are parallel to the axis 72 of insert tube 52. When this is done, the lifting operation proceeds with relative ease since the load rises upward without any requirement of sliding the roll 5 relative to surface 70. Remarkably, there is an effective transmission of upward force from the handle stem 14 to the load 5 via insert tube 52,53 even though lift stem 54, lift plate 60, pivot pin section 32B, and fulcrum plate 38 are in merely pivotable contact. The pin section 32B is long enough either with the aid of the lift stem 54 or by the pin 32B length itself to gain effective leverage on the top and bottom portions of insert tube end 53 for good lifting control. During lifting, the weight supporting plate 60 not only carries the weight of the load 5,6 but also strengthens the lift stem 54 from end rupture and relieves the pin section 32B from transverse bending failure and fracture. The pin section 32B provides excellent front-to-back and side-to-side stability for the lifted load 5, providing the horizontal line through the center of gravity (C.G.) of the load passes over pin axis 66 or slightly toward the handle stem 14 therefrom.

Once in the lifted condition of FIG. 4, the pivotable contact 38,32B,54,60 permits swivelling the dolly 10 relative to the lift member 50 to permit any one of a number of maneuvers of the load body 5 as more fully explained relative to FIGS. 5 and 6. Thus the lifting member 50 and dolly 10 according to the invention synergistically interact to provide many degrees of freedom of movement adapted to the needs of each of several steps of the inventive method with a relative simplicity of structure. Moreover, the simplicity of structure not only does not preclude multiple functions for every structural part, but also amply permits optimal selection of strengths of materials of each structural part so that an inventive unit has maximum load lifting capacity for a given weight of the inventive unit.

The pin-turning dolly component 10 is compatible as a dolly for other roofing purposes (and other laborer purposes in other applications) such as carrying a gravel spreader attachment, fork lift, insulation carrier attachment, and accessory basket for tools, pails, and roofing accessories (not shown). Because the lift member 50 in this embodiment enters only partway into either end of the roofing roll tube 6, the required lift tube weight is reduced, and laborer convenience is considerably enhanced. (Other embodiments more suitably comprise a lift tube traversing the entire interior of a load as the application requires.) Compatibility with other applications is further augmented by providing pin section 32B screwably attachable and detachable in pin section 32A so that other attachments are screwably attached to pin section 32B on dolly 10.

In another way of viewing the preferred embodiment of FIG. 1, the dolly 10 amounts to a transporting device having a body with wheels 16,18 mounted to the body for permitting the body to move along surface 70. The body includes the lifting pin 32 which has elongated section 32B having end 32C. The lifting pin section 32B is elongated in that its length exceeds its diameter and its direction of elongation is along axis 66. The body also has weight supporting fulcrum plate 38 mounted on the body in a fixed relation to lifting pin section 32B. Handle 14 provides means of turning lifting pin 32 around pin-turning axis 36 in the direction of arrow 71. Axis 36 is parallel to surface 70 and perpendicular to the pin elongation direction along axis 66 with the result that the first direction of elongation along axis 66 and pin-turning axis 36 lie in a common geometric plane 68 so that substantial mechanical advantage is obtained.

The load handling apparatus 1 further includes a lift member 50 which has the elongated section of pipe 52 which has its direction of elongation along pipe axis 72. This elongated section 52 is shaped cylindrically so as to be attachable slidably to the tube 6 of load 5. The section 52 admits of many variations such as a cylindrical tube; solid cylinder; cylinder fitted with roller bearings on its exterior to permit easy turning of the load around section 52; pipe or bar journalled relative to the receptacle assembly 54,60,62 to permit easy turning of the load and section 52 together; section undulating in diameter along its length; and bar with elliptical cross-section, half-moon cross-section or other cross-section. Accordingly, it is frequently useful to describe the elongated section as having a "direction of elongation" to account for a variety of its possible geometries, as a supplement to the more restrictive-sounding word "axis".

The lift member 50 further has a receptacle assembly 51 for pivotably and slidably receiving the lifting pin section 32B along direction 66 so that the direction of elongation of lift member section 52 is substantially perpendicular to the direction of elongation of the pin section 32B. Lifting pin 32 is advantageously cylindrical, and other elongated pin shapes can involve tapers, bulbs, undulating girths and so on. The receptacle assembly 51 also is a weight supporting element or arrangement which is pivotably supportive of the weight of the lift member 50 and the load 5,6 against the dolly body 10 when the lifting pin section 32B is inserted into the receptacle 54,60,62 so that one of the receptacle lift plates 60 or 62 comes into pivotable contact with weight supporting fulcrum plate 38 when the load is lifted.

In a safety advantage made possible by the simplicity of structure of the preferred embodiment 1, the receptacle 51 protectively surrounds all of section 32B of the lifting pin 32 within the receptacle 51 lift stem 54, when the lifting pin section 32B is inserted therein to the point where one of the lift plates 60 or 62 rests in pivotable contact with fulcrum plate 38. Because the preferred embodiment permits the pin end 32C to be free, the pin end does not project beyond the top of plate 62 either for any levering purpose or for securing the pin end 32C to any other structure in this preferred embodiment 1. Likewise, the structure is considerably simplified since the receptacle assembly 51 is supported and contacted only from below, that is, supported only by the dolly body below. The weight supporting fulcrum plate 38 and pin section 32B provide fully adequate support for and security from sidewise movement of the receptacle 51. The result is that while there can be a support structure, not shown, rigidly attached to the dolly body relative to the pin 32 and suitably arranged to additionally pivotably secure the receptacle assembly from above in some embodiments of the invention, such a support structure is not required in the preferred embodiment of FIG. 1 at a considerable savings in weight and complication in manufacturing and use.

From a force analysis point of view, the inventive embodiment 1 produces a highly advantageous mechanical advantage with the simple structure for several reasons. First, if the weight of the load body be W, and the angle between the lift stem axis 66 and the surface 70 be $\theta$ (initially the angle 106A), then the only part of the load weight W which has to be overcome in the lifting process is the lesser amount W cos $\theta$. This advantage is a direct result of the pin 32 and pin-turning axis 36 lying in a common geometric plane 68. As a numerical example, when the initial angle 106A is 45°, the load weight to be overcome is only cos (45°) or 71% of the load weight W, and as the angle $\theta$ is increased from the initial value at angle 106A up to 90°, the percentage drops sharply.

Second, the mechanical advantage of the long handle stem 14 length $L_H$ compared to the shorter distance $L_C$ from axle 22 to the center of gravity (C.G.) axis of the load 5 further decreases the force F required in direction 100 to an amount $$F=(L_C/L_H)\ W \cos \theta.$$

Third, the load weight W is itself an increasing function in $\theta$ for some kinds of loads such as rolls of flexible product. This occurs because as lifting is begun, the product 5, being flexible, largely rests on the ground surface 70 and is only gradually able to be made to clear the ground, transferring the weight to the dolly handle 12 and tires 16,18 gradually as angle $\theta$ is increased. So the weight transferred to the invention increases while the mechanical advantage through the function cosine ($\theta$) increases to compensate. As a result, the pulling force required at the handle is relatively uniform as the handle is pulled down, providing a human factor and safety advantage which conveniently reduces shocks to the structure of the invention as well and prolongs its life.

In another operator safety advantage, the arrangement of the preferred embodiment 1 lifts the load 5 by a downward force applied to hand grip 12 wherein the body weight of the laborer can add to the force being exerted, thereby reducing muscular exertion and spinal and abdominal strain which are more pronounced in upward lifting methods. This safety advantage does not, of course, deemphasize the importance of using the invention only in appropriate circumstances and load ranges and with personnel whose health, strength, and training are compatible with occupational safety, to which the safety advantage of the invention suitably adds.

In FIG. 4 the levering/lifting operation has been or is being completed. Handle stem 14 has been lowered so that skid plate 26 rests on ground surface 70 and load 5 is raised up to clear ground surface 70. Lift stem axis 66 is now vertical and angle $\theta$ is 90°, as illustrated at 106B. Since cosine (90°) is zero, the force required to maintain the load in the lifted condition is zero. Lift plate, or flange, 60 is now in swivellable contact with fulcrum plate, or flange, 38.

In a next step of the inventive method, the handle stem 14 is slightly raised to make skid plate 26 clear surface 70, and a horizontal force 8 is applied to hand grip 12 to push the load 5 over the ground surface 70. The full weight W of the load 5 now is transmitted by the weight supporting plates 60 and 38 of FIG. 4 to wheels 16 and 18. Rolling friction is the only substantial resistance to force 8. When the load 5 has been moved to a new location the dolly 10 is caused to cease moving over surface 70, and load body 5 is lowered to surface 70 suitably by reversing the steps described hereinabove.

In FIG. 5, a product roll 5 such as a carpet roll or a membrane roofing roll having a tube 6 with two rigid end projections is handled efficiently by two manually operated units 1 and 1' of the invention. An inventive lifting method such as is previously described is applied by means of each dolly-and-lift-member combination 1 and 1' at each end of the product roll tube 6 so that both ends become lifted with substantial mechanical advantage. The handle stems 14 and 14' are oriented perpendicular to the lift member axes 72 and 72' in plan view (but they are not in a common plane with the handle stems). Pushing forces 8 and 8' suffice to move the product roll in a direction transverse to lift member axes 72 and 72' and parallel to the pushing forces 8 and 8'. While the load 5 is in motion, the product roll tube 6 is suitably turned circumferentially on the lift members 50,50' when it is desired to wind or unwind product 5 from the tube 6.

FIG. 6 consists of 16 figures, FIGS. 6A,6B,6C,6D-,6E,6F,6G,6H,6J,6K,6L,6M,6N,6P,6Q, and 6R. A variety of reorientations of handles 14 and 14' of FIG. 5 (see numbering suggestion at FIG. 6A of the swivellable handles also) are shown in highly diagrammatic form to suggest the many orientations and maneuvers of which the invention is capable when the handle stems 14,14' are reoriented after the lifting step. In FIG. 6A, which shows correspondences to FIG. 5 shared in common with all the other FIG. 6 figures, small circles represent pivots which in FIG. 5 are represented by pin section 32B and the surrounding insert tube 54. Axes 36 and 36' are the respective wheel axes of each unit 10 and 10'. The exact corresponding FIG. 6 figure to the handle stem orientation of FIG. 5 is that of FIG. 6F.

To predict a given maneuver from the reorientations of the handle stems 14 and 14', the wheel axes 36 and 36' are extended in geometric construction lines to their point of intersection C, if any such intersection exists. If there is a point of intersection, it represents the center C of circular motion which the load 5 will execute so long as the handle stems 14 and 14' remain in the same orientation relative to each other.

In FIG. 6A, the units 1 and 1' and the load 5 execute a circle around a point C at a distance as shown. In FIG. 6B, the left unit 1 circles around its own pivot while the right unit 1' circles around the pivot of unit 1 as a center. In FIG. 6C the units circle around a more or less distant center point oppositely disposed from the load 5 compared to FIG. 6A. In FIG. 6D, the wheel axes 36,36' do not have a point of intersection, or equivalently their wheel axes 36,36' intersect at infinity, so the load 5 is constrained to move along the line of the lift member axes 72,72'. In FIG. 6E, unit 1' is constrained to swivel around its own pivot while unit 1 moves in a circle around the pivot of unit 1'.

In FIG. 6F, the corresponding diagram to FIG. 5, the wheel axes 36,36' are collinear. Accordingly, a center of circular motion can be selected from anywhere along the line of the axes 36,36', which is of infinite length. Thus, in FIG. 6F, depending on the relative magnitude and directions of the forces 8 and 8' applied to the units 1 and 1' the units can be made to circle around the pivot of either unit, around a center selected anywhere between the pivots, around a center at any selected distance to one side of either unit, or around infinity (movement in a straight line perpendicular to the axes 36,36'). FIG. 6J is similar in freedom of movement.

In FIGS. 6G,6H, and 6K movement pivots around the pivot of the right unit 1'. In FIGS. 6M,6P, and 6Q the movement circles around a center disposed midway and to one side relative to the two units 1 and 1' at a smaller radius of curvature than in FIGS. 6A and 6C.

In FIGS. 6L, 6N, and 6R the wheel axes 36,36' are parallel yet oblique in plan view to the line 72 between pivots. The result is that the load 5 is constrained to orient itself obliquely and to move in only one straight line perpendicular to the wheel axes 36,36'. This maneuver can help in negotiating tight spaces.

Referring to FIGS. 1 and 5, a method of moving the load 5 with two dollies 10 and 10' by only one worker is now described. The one worker lifts each end of product roll 5 by means of units 1 and 1' consecutively. Next, in each unit 1 and 1' of FIG. 1, a strong, suitable linch pin 79 is passed through holes 76 and 82 in adjacent plates 60 and 38 to lock them against swivellable movement, thereby locking lift member insert tube axis 72 parallel to wheel axis 36. (Holes 74,78 and 80 are provided for similar purposes for the plate 62 and for other orientations.) Next the worker fastens respective chains 111 and 112 to an appropriate point on each dolly 10 and 10' and the chains in turn to a single tractor or truck, not shown. The fastening points are selected so as to cause the skid plates 26,26' to just clear the ground surface 70 when in motion. An attachable and detachable wheel or second skid plate, not shown, is suitably provided on the forward side of axle 20 of FIG. 1 after lifting the load 5, to avoid capsizing. The tractor or truck is set in motion by the one worker thereby moving the load body 5 by units 1 and 1'.

Referring again to FIG. 5, it is readily observed that a series, or collection, of loads such as 5 can be lifted at once by numerous units 1,1',1'',1''', etc., of the invention by providing extensions such as 118 of the lift member 50' which are suitably inserted in the additional loads. The central axis 72' of extension 118 is suitably the same as the axis of the rest of lift member 50'. However, other lift members, not shown, of the invention suitably use plural insert tubes having parallel but not collinear axes, tubes with intersecting axes, and curved tubes. In this way, the invention is readily adapted for inexpensive and efficient handling of plural load bodies distributed over a surface 70 for simultaneous moving.

In FIG. 7 a load body 130, for example a large electric motor or generator or farm tractor, having projecting shaft ends 135 and 140 is readily lifted by the invention notwithstanding the lack of hollows or holes in the load 130, by sliding lift member insert tubes 145' and 145 over and around shafts 135 and 140 respectively in holdable juxtaposition with said shafts. Lift member receptacles such as 150 are provided as in FIGS. 1 and 5 to permit lifting and moving of the heavy load body 130.

For still other hard-to-handle load bodies having grippable projections or surfaces, the lift member is suitably provided with a large gripping plier mechanism, not shown, to slidably attach or holdably juxtapose each lift member to the respective projection.

In FIG. 8, a large load body 160 is suitably handled by units 180 and 180' of the invention according to a suitable method of the invention by taking advantage of shoulders 190 and 194. The shoulders 190,194 hold the inventive units 180 and 180' up close in elevation to the tubular projections 165 and 170 of the load body 160, while the load body 160 advantageously rests in depression 191,192,193 in a factory or outside environment. The units 180 and 180' lift the load 160 sufficiently to clear surface 192, thereby rendering the body 160 moveable with high load-carrying figure of merit.

In FIG. 9, a bundle of load bodies 206,207,208,209,210,211 are held together with strap 205. The bundle is handled by the invention by sliding one or more elongated portions 215 of a lift member between adjacent load bodies, and lifting and moving the bundle by the inventive apparatus and with an inventive method as previously discussed hereinabove.

In FIG. 10, an alternative receptacle structure for a lift member 250 is suggested. Insert tube 255 is provided at one end with radial holes 257 and 259 along a common axis 290. Weight supporting high-lift plate 266 with aperture 268 and weight supporting low-lift plate 262 with aperture 264 are provided perpendicular to common axis 290 with apertures 264 and 268 being centered on common axis 290. The plates 266 and 262 are weldably secured by welds 282,284,286 and 288 in position relative to each other by means of spacer plates 270 and 276. The spacer plates 270 and 276 are in turn supported on insert tube 255 by welds 272,274,278 and 280. A pivot pin section 32B of FIG. 1 is inserted along axis 290 into the receptacle of FIG. 10 in the course of engaging the dolly 10 with the lift member 250 and lifting a load 5,6, not shown.

Figure 11:
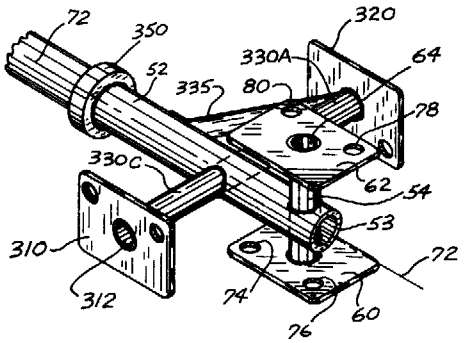
FIG. 11 is a perspective of an additional alternative receptacle assembly for a lift member in the combination article of the invention.

In FIG. 11, an additional variation of the lift member receptacle construction is shown. Most of the insert tube 52 to the left of insertion-limiting stop collar 350 is broken away for economy of space on the drawing.

As in FIG. 1, FIG. 11 shows insert tube end 53 provided with high-lift plate 62 and low-lift plate 60 on lift stem 54 projecting unequal first and second distances from tube end 53. Additional heights of lifting are provided with long lift stem 330 projecting unequal third and fourth distances 330A and 330C from tube 52. Third lift plate 310 is mounted around opening 312 of the long lift stem projection 330C. Triangular bracing 335 and additional bracing, beneath projection 330A, not shown, provides secure rigid mounting of fourth lift plate 320 and long lift stem projecting section 330A. Long lift stem 330A,330B,330C is provided perpendicular or at any other convenient orientation or angle to lift stem 54 and tube 52. In FIG. 11, long lift stem 330 is spaced in fact along tube 52 from lift stem 54 but is seen as being perpendicular to lift stem 54 along axis 72. In an interesting feature of the invention the use of one or more additional receptacle assemblies such as stem 330 provides many height selections of lifting with relatively little increase in unit weight. In addition, lift stem 330 provides a convenient insertion point for crowbar turning when lift stem 54 is oriented out of reach.

The description of receptacle assemblies herein is, of course, far from exhaustive. The scope of the invention, among other things, also includes receptacles integrally cast with the rest of the lift member or machined therefrom.

Figure 12:
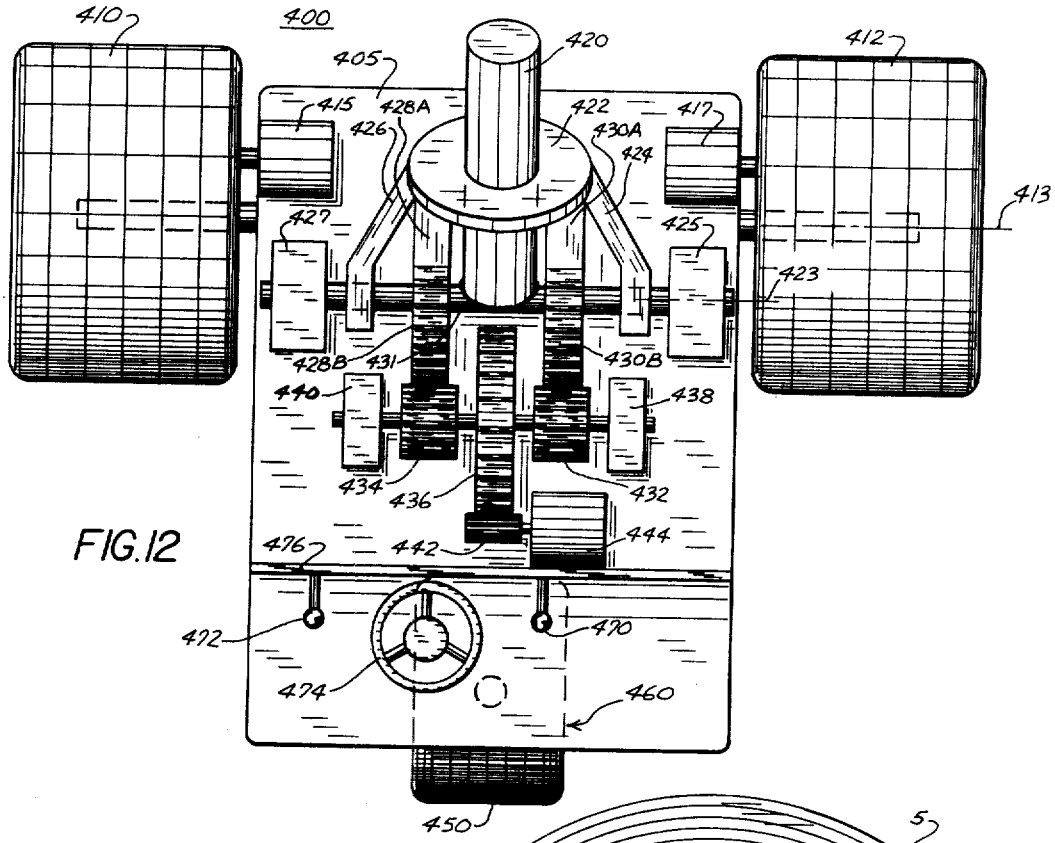
FIG. 12 is a plan view, simplified, of a motorized pivot pin lifting machine for use with a lift member (not shown) in another embodiment of the invention according to a method of the invention.

FIG. 12 suggests a motorized pin-turning dolly 400 for use with a lift member such as the type of member 50 of FIG. 1. Among other features, this pin-turning dolly 400 has pin-turning axis 423 being distinct from wheel axis 413. Pin-turning axis 423 is parallel to wheel axis 413, although such parallelism is not essential to proper operation.

The inventive embodiments provide extremely high ratios of capacity to lift load weight W to invention unit weight U (Figure of Merit being W/U). Accordingly, a glance at FIG. 12 indicates that lifting, moving, and otherwise handling load bodies of enormous size and weight such as buildings, ships, enormous digger machines, hydroelectric generators and other items, is contemplated with one or more units of an embodiment of the invention about the size of a dump truck.

Construction tires 410 and 412 are independently driven by reversible motor units 415 and 417 respectively. A third maneuvering and steering tire 450 is provided relatively small due to relatively smaller load-carrying demands upon it. Chassis 405 supports the motor units 415 and 417, operator's cab 460, and pivot pin machinery next described.

Pivot pin 420 is supported on bearing bases 425 and 427 by means of frame members 424 and 426 and axle 431. Pin 420 and axle 431 define and lie in a common geometric plane. Pivot pin 420 is supported further by rigid toothed sector masses 430A and 428A in the dimension transverse to said geometric plane. Weight supporting fulcrum plate 422 is secured both to pivot pin 420 and frame members 424 and 426. Sector masses 430A and 428A respectively bear exterior teeth 430B and 428B which for purposes of mechanical advantage are engaged to gears 432 and 434 of a reduction assembly. Gears 432, 434 and large gear 436 of the assembly are mounted on bearing supports 440 and 438. Large gear 436 in turn is coupled to motor assembly 444 by small gear 442.

Cab 460 is suitably enclosed and appointed with features conveniently accommodating a human operator, who observes the progress of the handling operations of unit 400 and its associated lift member, not shown, through observation port 476. Control and operation of motor units 415 and 417, lift motor unit 444, and third tire 450 are carried out by means of control levers including levers 472 and 470 and by means of steering wheel 474 operating through appropriate intermediate mechanisms and controlling units and control lines as the person skilled in the power machinery and automotive arts finds convenient to suitably adapt.

In carrying out an inventive method of handling enormous load bodies, a crane, not shown, is suitably used to insert the lift member, not shown, into the load body, not shown, and orient the receptacle part of the lift member for engagement with pin 420. The motorized pin-turning dolly 400 is moved into position with pin-turning axis 423 parallel to the lift member elongation. Pin 420 is adjusted as necessary while dolly 400 is moved forward, to effectuate engagement with the receptacle. Lifting now commences.

Pin 420 is turned under substantial power by motor 444 around the axis 423 thereby lifting the lift member and load body with preponderant mechanical advantage. The load body weight is gradually thrust onto the weight support plate 422 and ultimately onto the tires 410,412 which have been proportioned in size and strength to the task. The operator in cab 460 brings the pin 420 to vertical position, and then sets tires 410 and 412 into opposite rotations for swivelling unit 400 beneath the load. The operator then sets tires 410 and 412 into motion in the same direction to move the unit 400 and its load forward or backward. When the load has been suitably moved, the load is suitably lowered and brought to rest by reversing the steps hereinabove described.

Variations involving a dolly moving on rails or having endless tracks like a bulldozer are also suitable in the practice of the invention.

Inexpensive miniaturized versions of the invention are applicable in miniaturized lifting operations and in automated manufacturing and warehousing equipment for engaging and shuttling items of products. Entirely automatically controlled embodiments requiring little or no human supervision are also contemplated.

It is readily observed that the invention comprehends numerous embodiments and methods and variations and equivalents thereof within its spirit and scope. It is contemplated that the person skilled in the art will adapt the inventive articles of manufacture and methods in order that the utility of the invention can be fully realized in all fields of technology to which its features and advantages commend it.

I claim:

1. Load handling apparatus for handling a load body, said load handling apparatus comprising transporting means comprising body means and means mounted to said body means for permitting said body means to move along a surface;

said body means comprising lifting pin means having an elongated section having an end and having a first direction of elongation, first weight supporting means mounted on said body means in substantially fixed relation to said lifting pin means, and means for turning said lifting pin means around an axis substantially parallel to the surface and substantially perpendicular to said first direction of elongation so that said first direction of elongation and said axis lie in a common geometric plane;

said load handling apparatus further comprising lift member means having at least a second elongated section having a second direction of elongation, said second elongated section being shaped so as to be attachable slidably to said load body, and said lift member means further having receptacle means for pivotably and slidably receiving said lifting pin means elongated section so that said second direction of elongation is substantially perpendicular to said first direction of elongation, said first weight supporting means being pivotably supportive of the weight of said lift member means when said lifting pin means is inserted into said receptacle means;

said transporting means being orientable so that said axis is substantially parallel to said second direction of elongation, and said lifting pin means by said turning around said axis permitting lifting of said lift member means and said load body, said load handling apparatus thereby being able to lift and transport and thereby handle said load body, when said lift member means is slidably attached to said load body and said lifting pin means is received into said lift member means.

2. Load handling apparatus as claimed in claim 1 wherein said receptacle means protectively surrounds all of said end of said lifting pin means within said receptacle means when said lifting pin means is inserted into said receptacle means so that said first weight supporting means comes into pivotable contact with said receptacle means.

3. Load handling apparatus as claimed in claim 1 wherein said transporting means body means is a dolly body and said means mounted to said body means for permitting said body means to move along a surface is wheels attached to said dolly body, said wheels having a common axis of rotation, said axis of turning said lifting pin means being the same as said common axis of rotation of said wheels.

4. Load handling apparatus as claimed in claim 1 wherein said second elongated section is a cylindrical tube having a tube axis in the second direction of elongation, and said receptacle means comprises weight supporting plate means and further comprises an engagement tube, said engagement tube having two ends, said engagement tube being located and affixed transversely through said cylindrical tube, said weight supporting plate means comprising an apertured plate affixed around one of said ends of said engagement tube.

5. Load handling apparatus as claimed in claim 4 wherein said weight supporting plate means further comprises a second apertured plate affixed around the other of said ends of said engagement tube, and said engagement tube projects unequal distances from said cylindrical tube axis, whereby selectable heights of lifting are made possible.

6. Load handling apparatus as claimed in claim 1 wherein said transporting means body means is a dolly body and said means mounted on said body means for permitting said body means to move along a surface is wheels attached to said dolly body, said wheels having a common axis of rotation, said axis of turning said lifting pin means being the same as said common axis of rotation of said wheels;

said second elongated section of said lift member means being a cylindrical tube having a tube axis in the second direction of elongation, and said receptacle means comprising weight supporting plate means and further comprising engagement tube means, said weight supporting plate means being affixed around said engagement tube means.

7. Load handling apparatus as claimed in claim 6 wherein said engagement tube means comprises at least one tubular member having two ends, said engagement tube means tubular member being affixed transversely through said cylindrical tube and projecting unequal distances from said cylindrical tube axis whereby selectable heights of lifting are made possible.

8. In combination, a rollable dolly having a dolly body, two wheels mounted to said dolly body and having a common axis of rotation, said dolly having a handle stem extending from said dolly body, said stem being rigidly attachable to said dolly body;

an elongated dolly pin affixed to said dolly body so that said pin and said axis lie in a common plane and said pin is perpendicular to said axis, said pin being oriented so as to be approximately vertical during rolling use of said dolly, said pin having a first flange affixed to said pin at an intermediate point along the length of said dolly pin; and a detachable cylindrical lift member adapted for slidable attachment to a rigid body, said lift member having an engaging tube member transversely affixed to said lift member, said engaging tube member terminating in at least one second flange at one end of said engaging tube member, said dolly pin being insertable into said engaging tube member of said lift member so as to bring said first and second flanges into swivellable contact, said dolly means being orientable so that said axis is approximately parallel to said cylindrical lift member and said dolly being leverable at said handle stem to lift said lift member and said rigid body, and said rigid body and said dolly being then rollable and swivellable so as to move said rigid body.

9. The dolly combination claimed in claim 8 wherein said engaging tube has a second end in addition to said one end, said engaging tube being affixed to the lifting member so that said second end is at a different distance to the rest of said lifting member from the distance of said one end to the rest of said lifting member, said engaging tube member terminating in a third flange at said second end of said engaging tube member, said dolly pin being insertable into said second end of said engaging tube member of said lift member so as to bring said first and third bearing flanges into contact, whereby the height of lifting said lift member and said rigid body is selectable by selecting between said engaging tube one end and second end for inserting said dolly pin into said engaging tube.

10. A method of utilizing in combination, a rollable dolly having a dolly body, two wheels mounted to said dolly body and having a common axis of rotation, said dolly having a handle stem extending from said dolly body, said stem being rigidly attachable to said dolly body; an elongated dolly pin affixed to said dolly body so that said pin and said axis lie in a common plane and said pin is perpendicular to said axis, said pin being oriented so as to be approximately vertical during rolling use of said dolly, said pin having a first flange affixed to said pin at an intermediate point along the length of said dolly pin; and a detachable cylindrical lift member adapted for slidable attachment to a rigid body, said lift member having an engaging tube member transversely affixed to said lift member, said engaging tube member terminating in at least one second flange at one end of said engaging tube member, said dolly pin being insertable into said engaging tube member of said lift member so as to bring said first and second flanges into swivellable contact, said dolly means being orientable so that said axis is approximately parallel to said cylindrical lift member and said dolly being leverable at said handle stem to lift said lift member and said rigid body, and said rigid body and said dolly being then rollable and swivellable so as to move said rigid body, the method comprising the steps of slidably attaching said lift member to said rigid body, inserting said dolly pin into said engaging tube member of said lift member so as to bring said first and second bearing flanges into contact, orienting said dolly means so that said axis is approximately parallel to said cylindrical lift member;

levering said dolly by pulling downward at said handle stem so as to lift said lift member and said rigid body; and rolling said dolly so as to move said rigid body.

11. An article of manufacture for moving a product roll along a surface when said product roll has a central hollow product roll tube, said article of manufacture comprising a cylindrical insert tube having a central axis;

a tubular lift stem provided through said cylindrical insert tube perpendicular to said central axis, said lift stem extending unequal distances from said insert tube;

a high-lift plate and a low-lift plate respectively being apertured and affixed at each end of said tubular lift stem so that said high-lift plate and said low-lift plate are transverse to said lift stem and parallel to said central axis;

an axle;

first and second tire means rotatably mounted at each end of said axle respectively for rolling along said surface;

frame means of approximately U-shape affixed on said axle at each end of said frame means;

a pivot pin affixed perpendicular to the approximate center of said axle and further being affixed intermediately along said pivot pin to the approximate center of said frame, said pivot pin extending away from said frame;

a fulcrum plate affixed to said pivot pin and to the center of said frame transversely to said pivot pin;

a handle stem affixed to the approximate center of said axle, hand grip means being provided distally from said axle on said handle stem;

a frame brace being affixed at one end to the approximate center of said frame and being affixed at the other end to said handle stem intermediate along said handle stem so that said handle stem extends at an acute angle relative to a geometric plane defined by said pivot pin and said axle; and a skid plate being an approximately J-shaped strap affixed at one end to said handle stem and at the other end to the center of said axle so that said article of manufacture can rest in equilibrium on said surface on said tire means and said skid plate with said pivot pin being approximately vertical, said pivot pin being insertable into said tubular lift stem so that when said cylindrical insert tube has been inserted into said product roll tube and said axle is oriented approximately parallel to said central axis, pulling downward on said hand grip means suffices to bring one of said high-lift plate and said low-lift plate into weight supporting contact with said fulcrum plate thereby to lever up said product roll and permit movement of said product roll on said tire assemblies along said surface.

12. A method for moving over a surface a load body having at least one holdably juxtaposable body feature, said method comprising the steps of providing elongated lift member means each having a respective first direction of elongation, said lift member means also having weight supporting receptacle means transversely affixed to each said lift member means;

holdably juxtaposing each said lift member means relative to a corresponding said holdably juxtaposable body feature of said load body respectively;

providing rollable transporting means, each said transporting means having at least two wheels rotatable on a common wheel axis and each said transporting means having elongated pin means extending therefrom, each said transporting means further comprising means for obtaining leverage on each said pin means around a respective pin turning axis;

orienting each said transporting means so that each said pin turning axis is approximately parallel to said first direction of elongation of a corresponding one of said lift member means;

inserting said pin means into said receptacle means so that each said pin means is approximately perpendicular to said first direction of elongation of a corresponding one of said lift member means;

causing said means for obtaining leverage to lever each said pin means around each said pin turning axis, each said pin turning axis and each said pin means defining a respective common geometric plane, thereby levering said lift member means and said load body in a direction normal to said surface; and causing said transporting means to move along said surface thereby to move said load body over said surface.

13. The method claimed in claim 12 wherein said common wheel axis and said pin turning axis of at least one said rollable transporting means are coincident.

14. The method claimed in claim 12 wherein exactly two lift member means and exactly two rollable transporting means units are provided for operating said method on a specific said load body having at least two holdably juxtaposable body features respectively.

15. The method claimed in claim 14 wherein said method further comprises the step of swivellably reorienting at least one said transporting means beneath a corresponding one of said lifting member means subsequent to said levering step thereby to permit at least one of many maneuvers of said load body during said moving.

16. The method claimed in claim 14 wherein said method is applied to a hollow product roll tube, said juxtaposing step comprises inserting each of said lift member means partway into said hollow product roll tube, and said method further comprises the steps of causing said transporting means to cease moving along said surface; and lowering said load body to said surface.

17. The method claimed in claim 12 wherein said method is operated upon a load body comprising a windable product and a rigid product roll tube wherein said method further comprises the step of turning said product roll tube on said lift member means during said moving of said load body over said surface, whereby said roll of product is wound onto or unwound from said product roll tube.

18. A method for moving a roll of product wound around a hollow product roll tube, said method comprising the steps of providing a cylindrical lift member having an engaging tube member transversely affixed to said cylindrical lift member;

inserting said cylindrical lift member partway into said hollow product roll tube;

providing rollable transporting means having at least two wheels rotating on a common axis and having an elongated pin extending approximately perpendicular to said axis and further having lever arm means for obtaining leverage on said pin around said wheel axis;

inserting said pin into said engaging tube member of said lift member;

orienting said transporting means so that said axis is approximately parallel to said cylindrical lift member;

levering said lift member and said product roll tube by means of said lever arm of said transporting means so as to lift said product roll; and rolling said transporting means so as to move said lifted product roll.

* * * * *